US009903141B2

(12) United States Patent
Foster

(10) Patent No.: US 9,903,141 B2
(45) Date of Patent: Feb. 27, 2018

(54) WASTE CONTAINER WITH IMPROVED LATCH

(71) Applicant: Derick Foster, Huntington Beach, CA (US)

(72) Inventor: Derick Foster, Huntington Beach, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 706 days.

(21) Appl. No.: 14/181,775

(22) Filed: Feb. 17, 2014

(65) Prior Publication Data

US 2014/0299619 A1 Oct. 9, 2014

Related U.S. Application Data

(60) Provisional application No. 61/810,089, filed on Apr. 9, 2013, provisional application No. 61/868,694, filed (Continued)

(51) Int. Cl.

| | |
|---|---|
| ***B65D 43/22*** | (2006.01) |
| ***B65D 45/16*** | (2006.01) |
| ***E05B 65/00*** | (2006.01) |
| ***B65F 1/16*** | (2006.01) |
| ***E05C 3/14*** | (2006.01) |
| *B65D 43/16* | (2006.01) |
| *B65F 1/14* | (2006.01) |
| *B65F 1/02* | (2006.01) |

(52) U.S. Cl.

CPC ..... *E05B 65/006* (2013.01); *B65F 1/1615* (2013.01); *E05C 3/145* (2013.01); *B65F 1/02* (2013.01); *B65F 1/1473* (2013.01)

(58) Field of Classification Search

CPC ..... A47F 3/16; A47G 19/22; B65D 25/40; B65D 25/42; B65D 25/44; B65D 47/24; B65D 47/28; B65F 1/122; B65F 1/1473; B65F 1/1615; B65F 1/1646; B65F 1/02; E25B 65/006; E03C 3/145

USPC ..... 220/705, 708, 325, 324, 908, 835; 215/18, 229, 11.4, 311; 222/566

See application file for complete search history.

(56) References Cited

U.S. PATENT DOCUMENTS 372,680 A 11/1887 Ketcham
806,885 A 12/1905 Focht
(Continued)

*Primary Examiner* — J. Gregory Pickett
*Assistant Examiner* — Niki M Eloshway
(74) *Attorney, Agent, or Firm* — Carlson, Gaskey & Olds PC

(57) ABSTRACT

A waste container includes a body having a base and a side wall extending upward from the base to define a container interior. A lid is hingeably secured to an upper portion of the side wall. A latch assembly selectively secures the lid to the side wall. The latch assembly includes a handle portion and a rotatable latch portion rotatable about an axis. The rotatable latch portion has a latch member that selectively interlocks with a hook portion. In one example, at least one additional rotatable member is mounted to the latch assembly that is independently rotatable relative to the rotatable latch portion. In one example, the container includes a release component that is independently operable of the latch assembly to unlatch the lid. In one example, the lid includes at least one flexing channel to control flexing movement of the lid.

35 Claims, 13 Drawing Sheets

Related U.S. Application Data on Aug. 22, 2013, provisional application No. 61/877,395, filed on Sep. 13, 2013.

(56) References Cited

U.S. PATENT DOCUMENTS 1,466,606 A 8/1923 Trageser et al.
1,559,594 A 11/1925 Wentorf et al.
2,873,880 A 2/1959 Poulos
3,273,747 A 9/1966 Kalz
3,390,804 A 7/1968 Morgan
3,490,637 A 1/1970 Pope
4,111,476 A 9/1978 Jacobs
4,279,357 A 7/1981 Robinson
4,286,636 A * 9/1981 Credle ..... B65D 83/0055 138/115
4,319,762 A 3/1982 Streit et al.
4,384,656 A 5/1983 McQuiston et al.
4,691,840 A 9/1987 Ferbrache
4,818,502 A 4/1989 Taschner
4,819,827 A 4/1989 DiSesa
4,917,261 A 4/1990 Borst
4,976,364 A * 12/1990 Solomon ..... A47G 19/2266 215/229
4,986,438 A 1/1991 Borst
5,050,762 A 9/1991 Giorgi
5,071,024 A 12/1991 Delmerico et al.
5,103,994 A 4/1992 Doxey et al.
5,160,060 A 11/1992 Garofalo, Jr.
5,163,577 A 11/1992 Lee
5,251,780 A 10/1993 Lee
5,490,606 A 2/1996 Lombardo
5,520,303 A 5/1996 Bernstein et al.
5,547,104 A 8/1996 Parker
5,699,929 A 12/1997 Ouno
5,738,395 A 4/1998 Probst
5,906,292 A 5/1999 Rider, Jr.
5,960,983 A 10/1999 Chan
6,116,452 A 9/2000 Hamel et al.
6,135,311 A * 10/2000 Panec ..... A47G 19/2266 220/705
6,250,492 B1 6/2001 Verbeek
6,276,557 B1 8/2001 Wysocki
6,328,320 B1 12/2001 Walski et al.
6,350,418 B1 2/2002 Venderpool et al.
6,698,608 B2 3/2004 Parker et al.
6,789,692 B2 9/2004 Prezelin
7,073,677 B2 7/2006 Richardson et al.
7,204,382 B2 * 4/2007 Cezeaux ..... A45F 3/16 215/229
7,559,433 B2 7/2009 Yang et al.
7,775,394 B2 * 8/2010 Naesje ..... B65D 47/248 137/455
7,918,362 B2 4/2011 Schmitt
8,505,783 B2 * 8/2013 Gill ..... A45F 3/20 215/388
2003/0038142 A1 2/2003 Gee
2003/0155366 A1 8/2003 Raghunathan
2005/0121405 A1 * 6/2005 Drajan ..... A47G 19/2272 215/11.4
2006/0043099 A1 3/2006 Zer et al.
2006/0283896 A1 * 12/2006 Kasting ..... B65D 47/24 222/549
2009/0223965 A1 9/2009 Raghunathan
2009/0245981 A1 10/2009 Miyajima et al.
2010/0108700 A1 * 5/2010 Scott ..... B65D 47/24 220/705
2010/0270337 A1 * 10/2010 Green ..... B05B 1/3026 222/566
2011/0248054 A1 * 10/2011 Darby ..... F16K 7/02 222/522
2012/0000909 A1 1/2012 Chameroy et al.
2012/0055930 A1 3/2012 Foster
2013/0214012 A1 * 8/2013 Pils ..... B65D 47/243 222/524

* cited by examiner

SECTION A-A

WASTE CONTAINER WITH IMPROVED LATCH

RELATED APPLICATIONS

This application claims priority to U.S. Provisional Application No. 61/810,089, filed Apr. 9, 2013, U.S. Provisional Application No. 61/868,694, filed Aug. 22, 2013, and U.S. Provisional Application No. 61/877,395, filed Sep. 13, 2013.

BACKGROUND OF THE INVENTION

The present invention relates to a waste container that includes a latch that prevents animals from being able to access an interior of the container but which can also allow cart lifters to lift and dump waste even if the lid remains latched.

Waste containers, such as for trash, recycling, or organic waste (compost), etc., often attract the interest of animals, such as rodents, dogs, raccoons, etc. Many containers include lids that latch, but some animals can pry under the lid and force the container open. For areas where the collection trucks include cart lifters, the containers might become damaged if they are lifted and dumped while latched.

SUMMARY OF THE INVENTION

A waste container includes a body having a base and a side wall extending upward from the base to define a container interior. A lid is hingeably secured to an upper portion of the side wall. A latch assembly selectively secures the lid to the side wall. The latch assembly includes a handle portion and a rotatable latch portion rotatable about an axis. The rotatable latch portion has a latch member that selectively interlocks with a hook portion.

In one example, at least one additional rotatable member is mounted to the latch assembly that is independently rotatable relative to the rotatable latch portion.

In one example, the waste container includes a release component that is independently operable of the latch assembly to unlatch the lid.

In one example, the lid includes at least one flexing channel to control flexing movement of the lid.

These and other features of the present invention can be best understood from the following specification and drawings, the following of which is a brief description.

DETAILED DESCRIPTION

Figure 1:
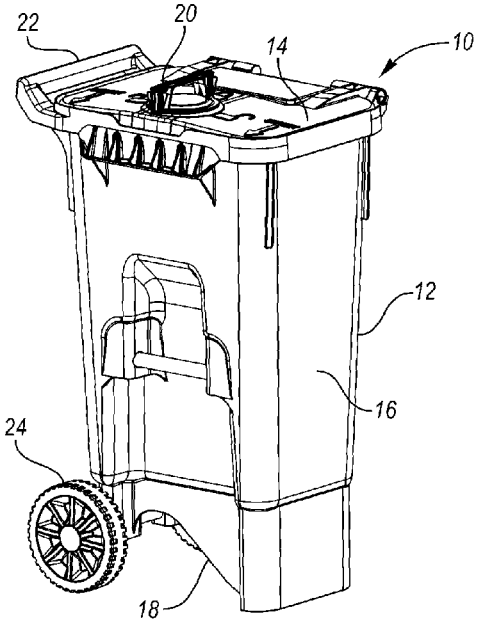
FIG. 1 is a front left side perspective view of a waste container according to one embodiment.
Figure 2:
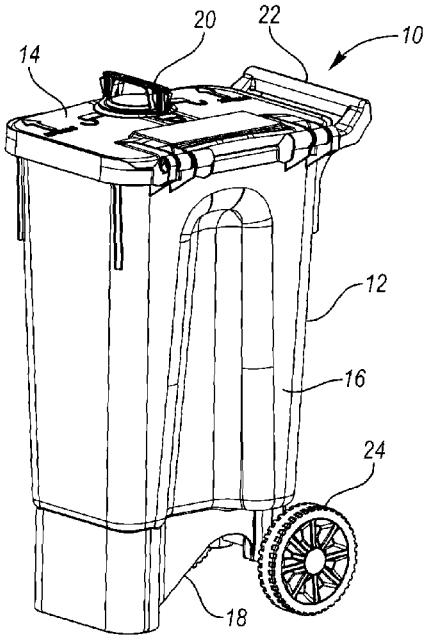
FIG. 2 is a front right side perspective view of the container of FIG. 1.

A container, such as a roll out cart 10, according to one embodiment of the present invention is shown in FIGS. 1 and 2. The roll out cart 10 generally includes a container body 12 and a lid 14 pivotably connected to the container body 12 for selectively providing access to an interior of the container 12. The container body 12 includes a side wall 16 extending upwardly from a base 18 to define the container interior. A latch 20 selectively prevents the lid 14 from opening. In FIGS. 1 and 2, the latch 20 is shown in the latched (locked) position, in which the lid 14 cannot be opened. The roll out cart 10 may include a handle 22 and wheels 24 to facilitate moving the roll out cart 10.

Figure 3:
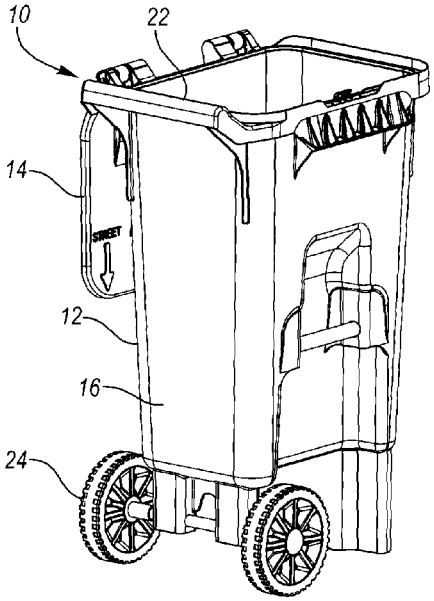
FIG. 3 is a rear left side perspective view of the container of FIG. 1 with a lid in an open position.
Figure 4:
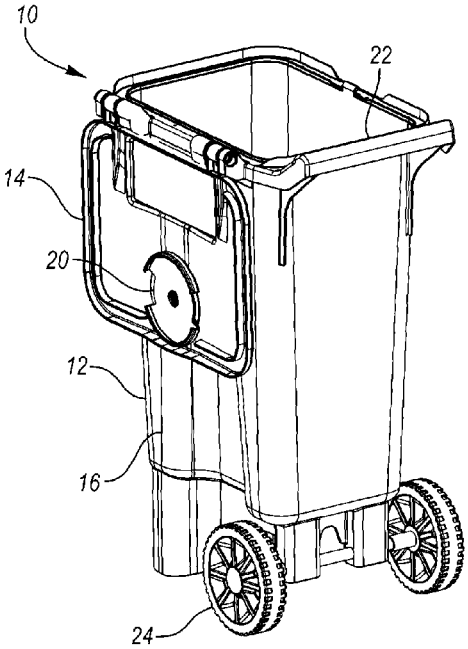
FIG. 4 is a rear right side perspective view of the container of FIG. 3.

In FIGS. 3 and 4, the lid 14 is shown in the open position. Although the lid 14 is shown hinged generally perpendicularly to the handle 22, the lid 14 may alternatively be hinged adjacent the handle 22 or opposite the handle 22.

Figure 5:
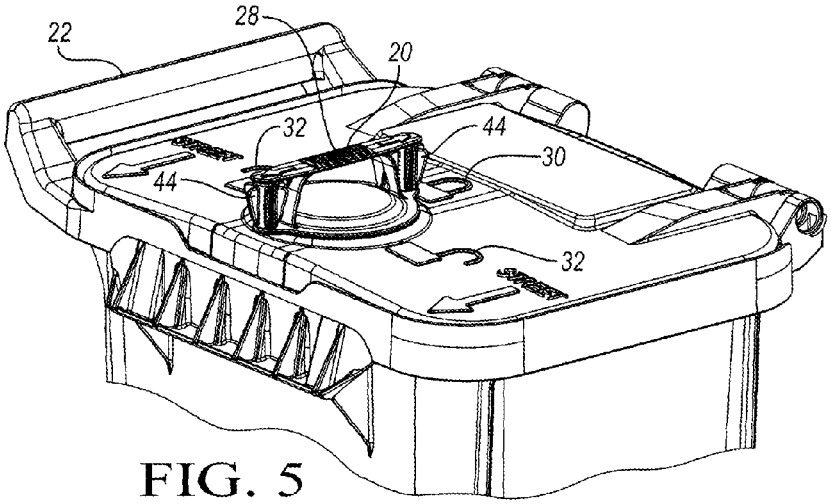
FIG. 5 is a perspective view of a lid of the container of FIG. 1.

FIG. 5 is an enlarged perspective view of the lid 14 and latch 20 of the roll out cart 10. The latch 20 is rotatable relative to the lid 14 and includes a handle 28 that is rotatable in a plane generally parallel to the lid 14. Locked indicia 30 and unlocked indicia 32 may be molded into the upper surface of the lid. When the handle 28 of the latch 20 is rotated into alignment with the locked indicia 30, this indicates that the latch 20 is locked and the lid 14 cannot be opened. When the handle 28 of the latch 20 is rotated into alignment with the unlocked indicia 32, this indicates that the latch 20 is unlatched and the lid 14 can be opened.

Figure 6:
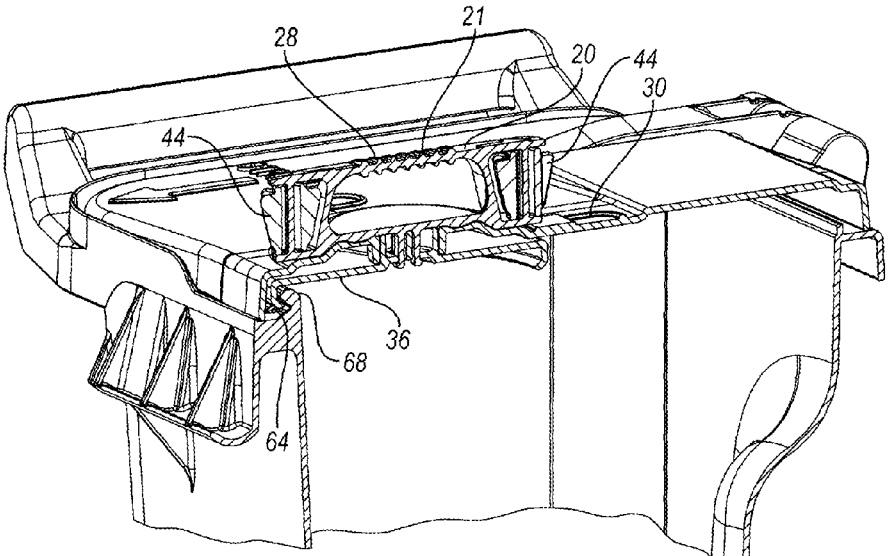
FIG. 6 is a section view of the lid shown in FIG. 5.
Figure 8:
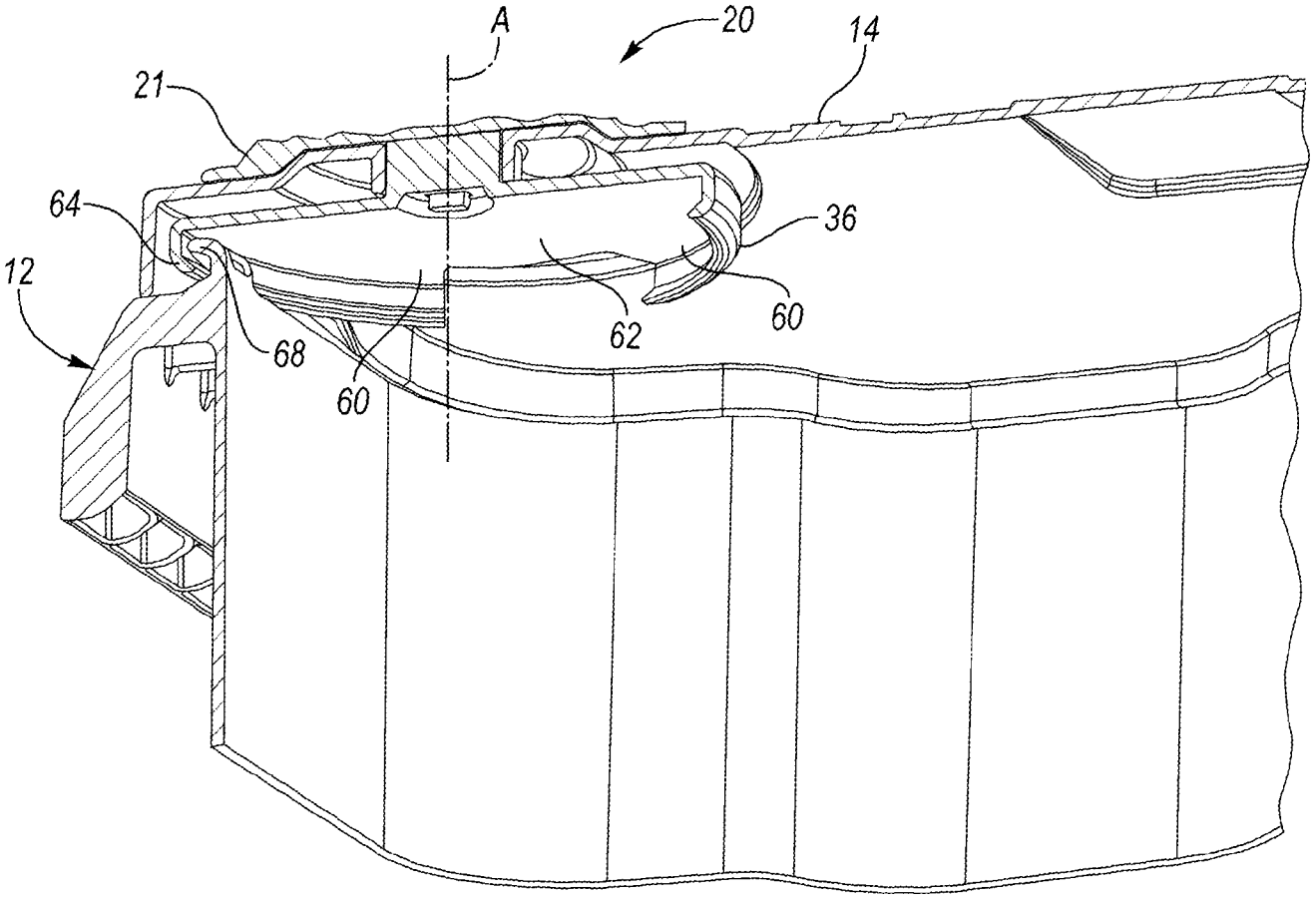
FIG. 8 is a section view of a bottom of the lid of FIG. 5.
Figure 9:
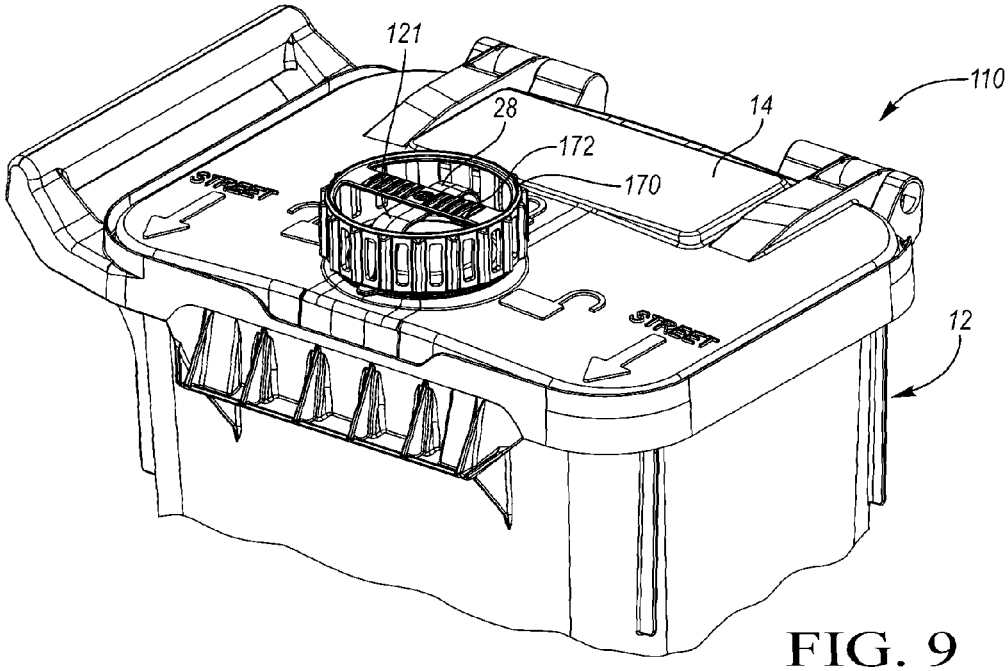
FIG. 9 is a top perspective view of a lid with another embodiment of a latch.

FIG. 6 is a section view of the roll out cart 10 of FIG. 5. The latch 20 includes the handle 28 as part of an upper latch portion 21. The upper latch portion 21 is positioned on an external side of the lid 14. The latch 20 further includes a generally disc-shaped lower latch portion 36 below the lid 14 and snap-fit (or otherwise connected) to the upper latch portion 21. The lower latch portion 36 is positioned on an internal side of the lid 14 and when the upper and lower latch portions are secured together they rotate together about an axis A (FIG. 8). In FIG. 6, the latch 20 is rotated to the locked position, in which the handle 28 is aligned with the locked indicia 30.

Figure 7:
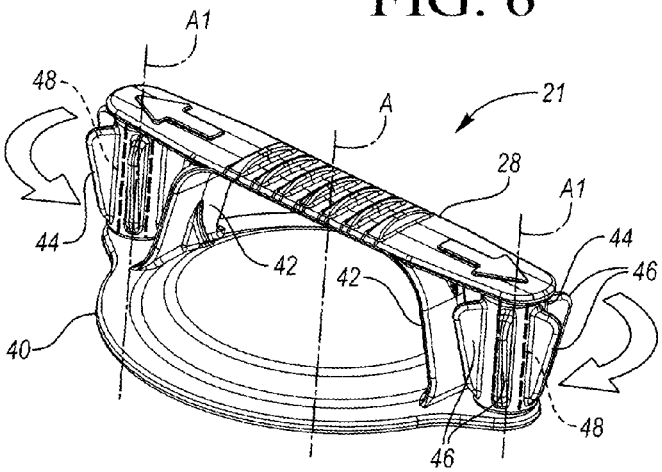
FIG. 7 is perspective view of an upper latch portion as used with the container of FIG. 1.

FIG. 7 is a perspective view of the upper latch portion 21. The upper latch portion 21 includes a base 40 having supports 42 extending to the handle 28. Paddles or rotatable members 44 extend between the handle 28 and the base 40 outward of the supports 42. The rotatable members 44 may include radially extending fins 46 and are rotatably mounted on pins 48 extending between the handle 28 and the base 40 outward of the supports 42. In the example shown in FIGS. 1-8, the rotatable members 44 rotate about axes A1 that are offset from the axis A.

The rotatable members 44 help prevent a rodent from being able to rotate the handle 28 and the upper latch portion 21. If the rodent tries to push on the rotatable member 44 to rotate the handle 28, the rotatable member 44 will just rotate about the pin 48, thereby depriving the rodent of leverage on the handle 28. The rotating members 44 may also distract and occupy the rodent and thereby prevent the rodent from opening the lid 14.

Referring to FIG. 8, the lower portion 36 is generally disc-shaped and includes large diameter portions 60 and small diameter portions 62. Notches are defined between the large diameter portions 60, outward of the small diameter portions 62. In this example, the large diameter portions together occupy approximately ⅔ of the circumference of the lower latch portion 36, while the two opposed small diameter portions 62 together comprise approximately the remaining ⅓ of the circumference of the lower latch portion 36 (approximately 60° each). Alternatively, a single small diameter portion 62 could be provided. Further, alternatively, the larger diameter portions 60 and small diameter portions 62 could have different relative sizes, depending upon the application or depending upon user preferences.

A latch member 64 protrudes downwardly and radially inwardly from an outer periphery of the larger diameter portions 60 of the lower latch portion 36. As shown, the latch member 64 may be arcuate. A forward facing hook 68 is formed adjacent an upper edge of the container body 12. The hook 68 engages the latch member 64 of the latch lower portion 36 thus, latching the lid 14 to the container body 12. The latch assembly includes the upper latch portion 21, lower latch portion 36 and hook 68. In the example shown, the hook 68 is integrally formed with the container body 12 as one piece.

In use, a user places waste in the container body 12 and rotates the handle 28 of the latch 20 about an axis generally transverse to the lid 14 to the locked position, in which the handle 28 is aligned with the locked indicia 30. This engages the latch member 64 with the hook 68 and latches the lid 14 to the container body 12.

On waste pick-up day, the user can wheel the roll out cart 10 to the curb and then rotate the handle 28 of the latch 20 to the unlocked position, where the hook 68 on the container body 12 would be aligned with one of the smaller diameter portions 62 of the lower latch portion 36. When the driver of the waste truck arrives, the driver can see whether the lid 14 is locked or unlocked. If the lid 14 is unlocked, the driver can use the cart lifter on the truck (e.g. using the grab bar and/or portions of the side walls 16) to lift the roll out cart 10 and dump the contents into the truck. If the driver sees that the handle 28 of the latch 20 is still in the locked position, the driver will not attempt to dump the cart 10 while the lid is latched. The driver or another worker can then rotate the latch 20 to the unlocked position to dump the cart 10. Another beneficial feature is that after the cart 10 has been dumped, as the lid 14 closes back down after being released by the cart lifter, and if the lid closing force is sufficient, the latch member 64 can slip over the hook 68 to re-latch the lid 14 without requiring any user input.

FIGS. 9-12 illustrate an alternate cart 110 with an alternate upper latch portion 121 having an additional a rotatable member that is independently rotatable relative to the handle 28. In this example, the additional rotatable member comprises a rotatable carousel 170 mounted for rotation relative to the upper latch portion 121. The cart 110 shown includes the same container body 12 and lid 14 as in the previous embodiment.

The upper latch portion 121 includes a base 140 and supports 142 extending upward from the base 140 to the handle 128. The carousel 170 includes a handle 172 extending across a diameter of a cylindrical body 174 that is rotatably mounted to the base 140 of the upper latch portion. Alternatively, or additionally, the handle 172 of the carousel 170 is rotatably mounted to the handle 128 of the upper latch portion 121. Fins 176 protrude outwardly from the cylindrical body 174. Openings 178 may be formed through the cylindrical body 174.

Figure 10:
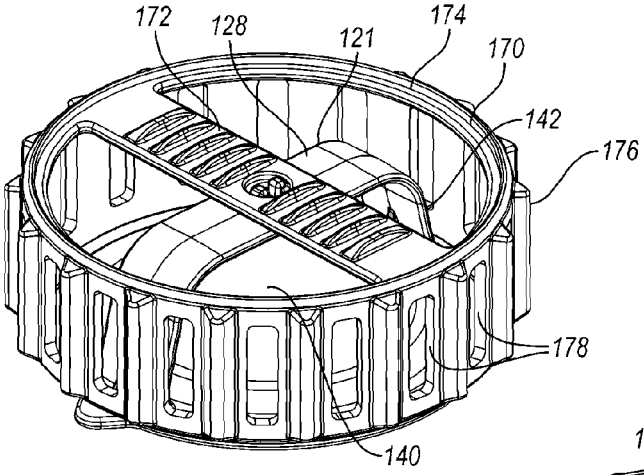
FIG. 10 is a perspective view of the latch of FIG. 9 is a first position.
Figure 11:
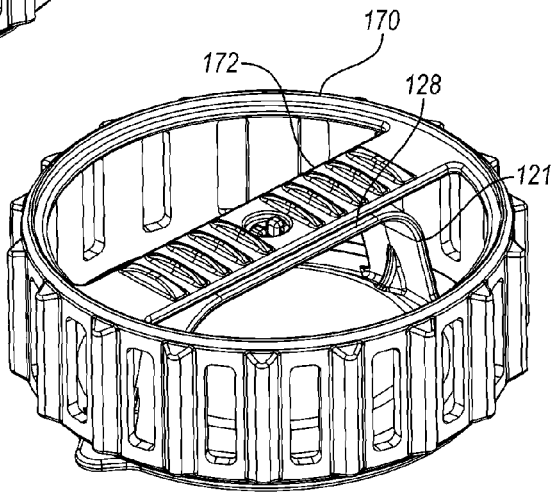
FIG. 11 is a view similar to FIG. 10 but showing the latch in a second position.
Figure 12:
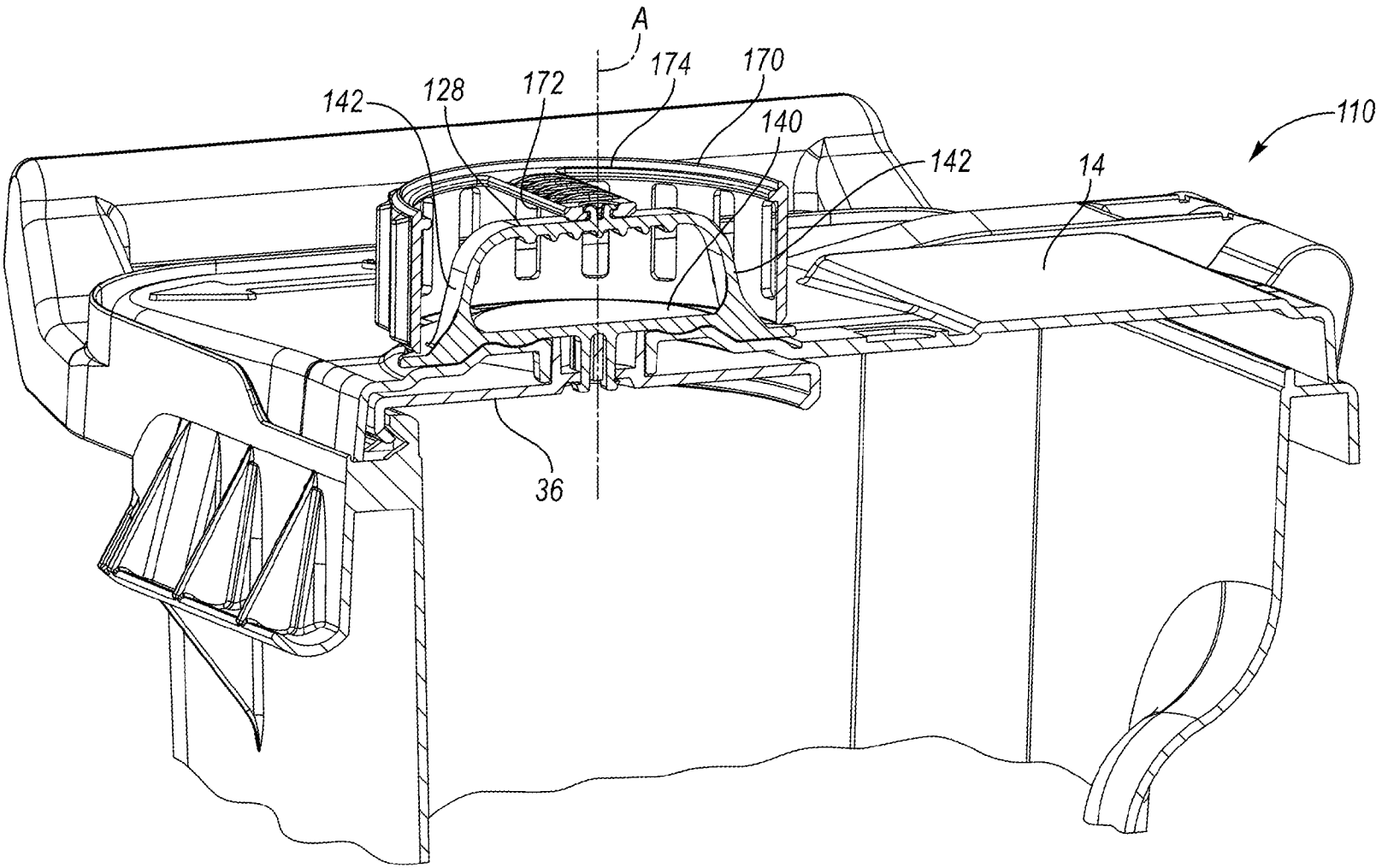
FIG. 12 is a section view of the lid shown in FIG. 9.

As shown in FIGS. 10 and 11, the carousel 170 can be rotated relative to the upper latch portion 121 which rotates about the axis A. In the example shown, the upper latch portion 121 and the carousel 170 both rotate about the axis A (FIG. 12). A rodent trying to open the latch would simply rotate the carousel 170 without releasing the latch. A human user would align and grasp both the handle 172 of the carousel 170 and the handle 128 of the upper latch portion 121. The user could then rotate the handle 128 and the upper latch portion 121 to lock or unlock the lid 14.

Figure 15:
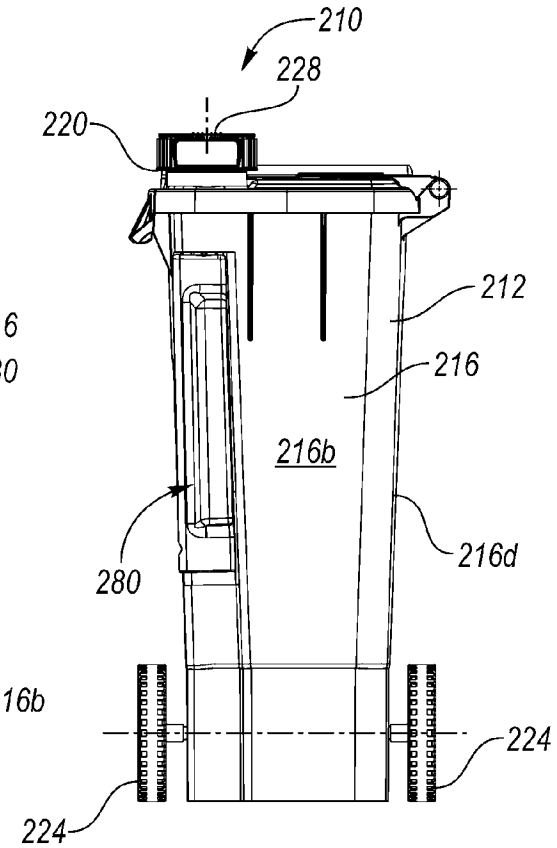
FIG. 15 is a front view of the container of FIG. 13.
Figure 14:
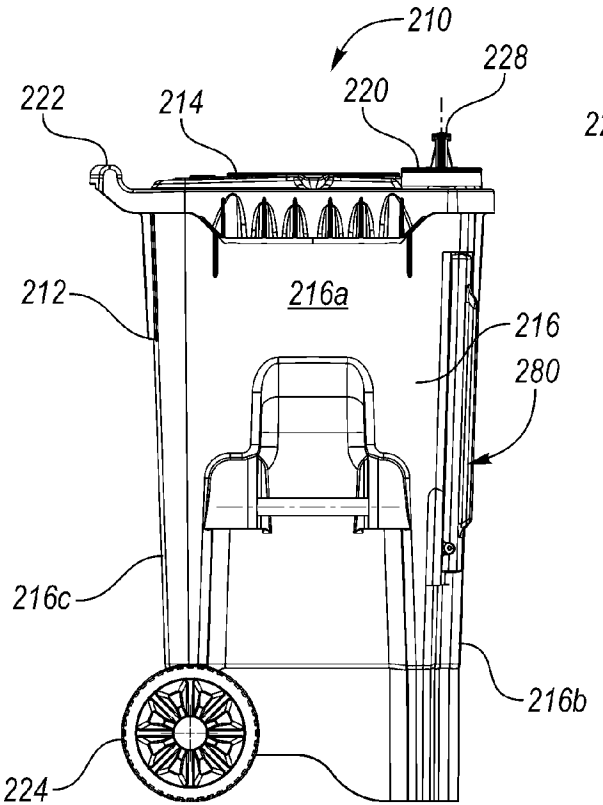
FIG. 14 is a side view of the container of FIG. 13.
Figure 13:
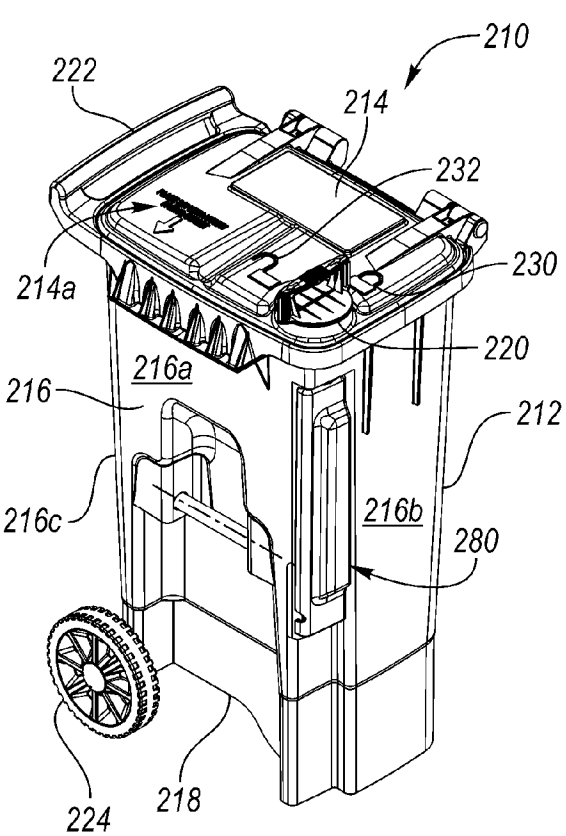
FIG. 13 is a front perspective view of a waste container according to another embodiment.

FIGS. 13-19 illustrate an alternate cart 210 having an alternate latch configuration that can be unlocked by a cart lifter even when the latch has been left in the locked position by the user. The exemplary roll out cart 210 generally includes a container body 212 and a lid 214 pivotably connected to the container body 212 for selectively providing access to an interior of the container body 212. The container body 212 includes a side wall 216 extending upwardly from a base 218 to define the container interior. A latch assembly 220 selectively prevents the lid 214 from opening. In FIGS. 13-15, the latch assembly 220 is shown in the latched (locked) position, in which the lid 214 cannot be opened. The roll out cart 210 may include a handle 222 and wheels 224 to facilitate moving the roll out cart 210.

In FIGS. 13-15, the lid 214 is shown in the closed position. Although the lid 214 is shown hinged generally perpendicularly to the handle 222, the lid 214 may alternatively be hinged adjacent the handle 222 or opposite the handle 222.

FIG. 13 is a perspective view of the cart 210. The lid 214 includes a visual position indicator **214*a* that identifies how the cart 210 should be positioned relative to a street for pick-up. In the example shown, the visual position indicator 214*a* explains that the cart 210 should be positioned such that the arrow 214*b* faces the street. The use of an arrow is just one example of a visual position indicator 214*a***, it should be understood that other indicators, symbols, markings, etc. could also be used.

The side wall 216 includes a street facing or front portion **216*a*, a first side portion 216*b*, a second side portion 216*c*, and a rear portion 216*d*. In this example configuration, the lid 214 is hinged to the rear portion 216*d* and the latch assembly 220 is positioned adjacent one of the edges of the lid 214 near one of the side portions 216*b* or 216*c* of the side wall 216. The latch assembly 220 includes a release component 280 that will allow a cart lifter to unlatch the latch 200 from a locked position when the user has left the latch assembly 220 in the locked position such that the cart 210 can be emptied without the driver having to leave the truck to unlock the lid 214. In the example shown, the release component 280 is mounted to the side wall 216***b* or 216*c* that is adjacent to the latch assembly 220 on the lid 214. The operation of the release component 280 will be discussed in greater detail below.

FIG. 14 is a front view of the cart 210 as the cart 210 would be viewed from the street.

FIG. 15 is a side view of the cart 210.

Figure 16:
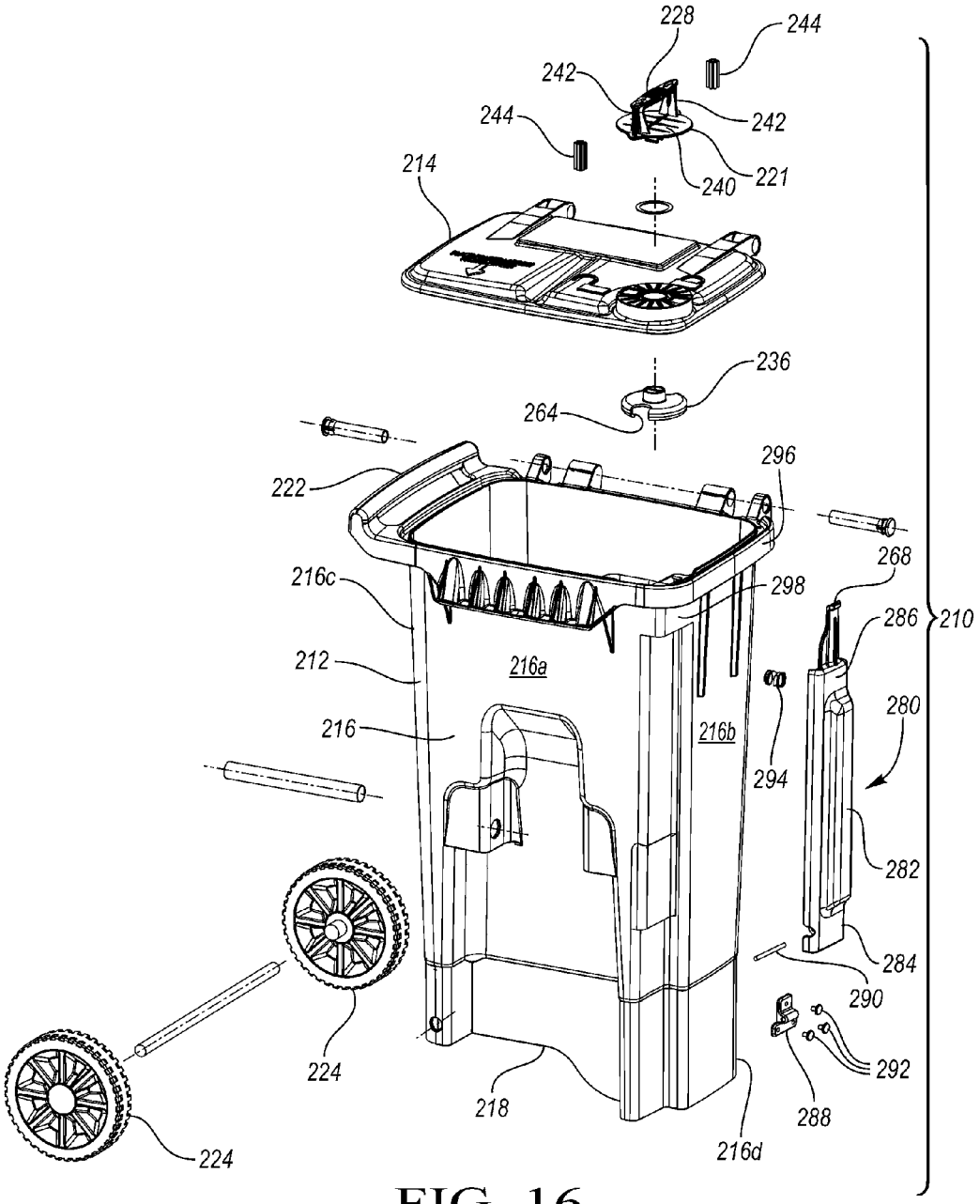
FIG. 16 is an exploded view of the container of FIG. 13.

FIG. 16 is an exploded view of the cart 210. The latch assembly 220 operates in a manner similar to the latch 20 discussed above. Further, the latch assembly 220 could also be used with the carousel 170 as shown in the embodiment of FIGS. 9-12. The latch assembly 220 is rotatable relative to the lid 214 and includes a handle 228 that is rotatable in a plane generally parallel to the lid 214. Locked indicia 230 and unlocked indicia 232 may be molded into the upper surface of the lid. When the handle 228 of the latch assembly 220 is rotated into alignment with the locked indicia 230, this indicates that the latch assembly 220 is locked and the lid 214 cannot be opened by a user gripping the lid in an attempt to rotate the lid 214 relative to the body 212. However, when the latch assembly 220 is aligned with the locked indicia 230, the lid 214 can be opened by a cart lifter by actuating the release component 280. When the handle 228 of the latch assembly 220 is rotated into alignment with the unlocked indicia 232, this indicates that the latch assembly 220 is unlatched and the lid 214 can be opened.

As shown in FIG. 16, the latch assembly 220 includes the handle 228 as part of an upper latch portion 221. The latch assembly 220 further includes a generally disc-shaped lower latch portion 236 below the lid 214 and snap-fit (or otherwise connected) to the upper latch portion 221. The upper latch portion 221 includes a base 240 having supports 242 extending to the handle 228. Paddles or rotatable members 244 extend between the handle 228 and the base 240 outward of the supports 242. The rotatable members 244 operate as described above.

The lower portion 236 is configured similarly to lower portion 36 described above. The lower portion 236 includes a latch member 264 that protrudes downwardly and radially inwardly from an outermost periphery of the lower latch portion 236.

The release component 280 is independently operable of the latch assembly 220 to unlatch the lid 214. The release component is capable of unlatching the lid 214 without having to rotate the latch 264. As shown in FIG. 16, the release component 280 comprises a compression bar 282 having an elongated body that extends vertically from a lower end 284 to an upper end 286. The lower end 284 is mounted to the side wall 216 with a pivot bracket 288 and pivot or lock pin 290. Fasteners 292 can be used to secure the bracket 288 to the side wall 216.

Figure 17:
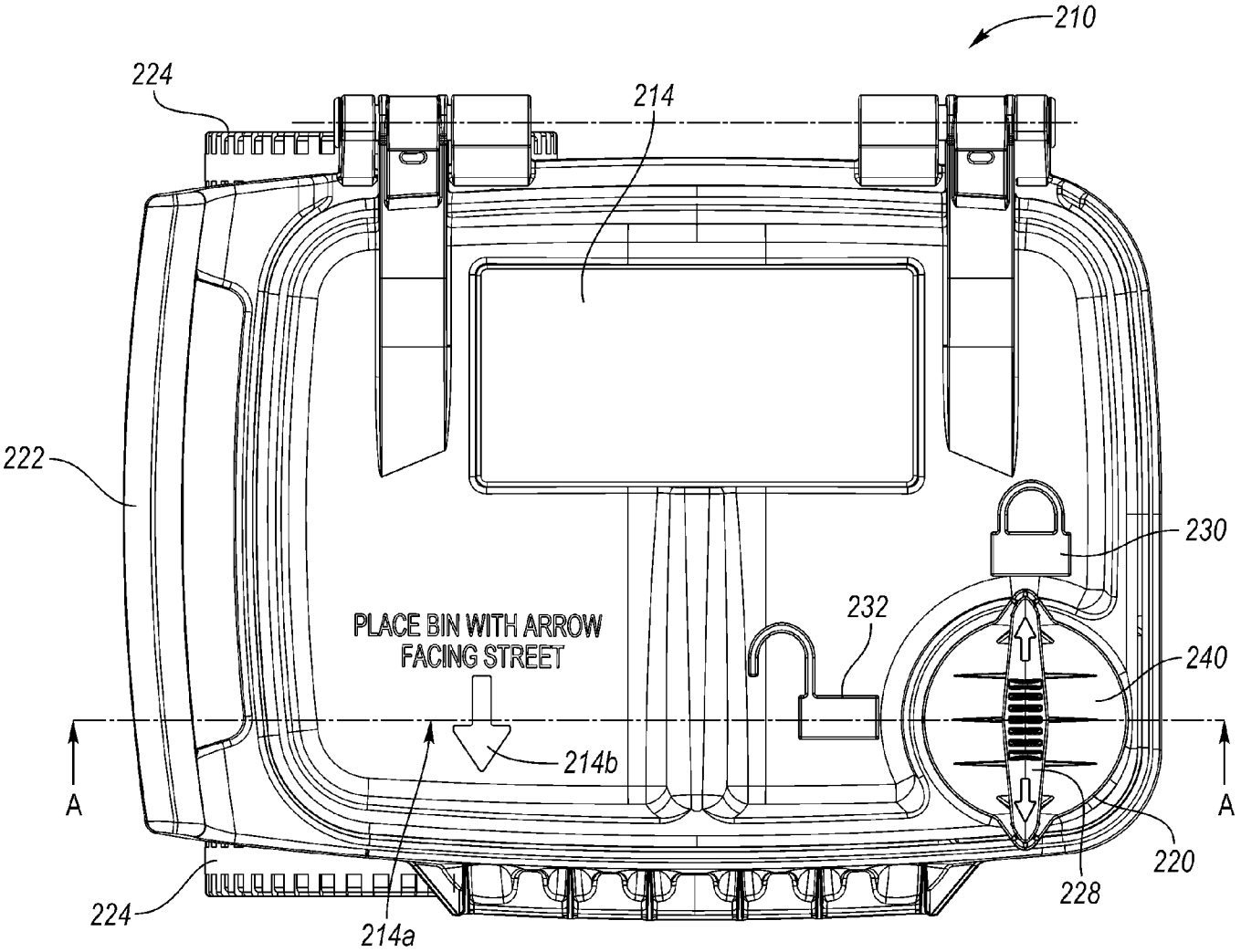
FIG. 17 is a top view of the container of FIG. 13.

FIG. 17 shows a top view of the cart 210. The latch assembly 220 in FIG. 17 is shown as being in the locked position by the visual indicator associated with the handle 228.

Figure 18:
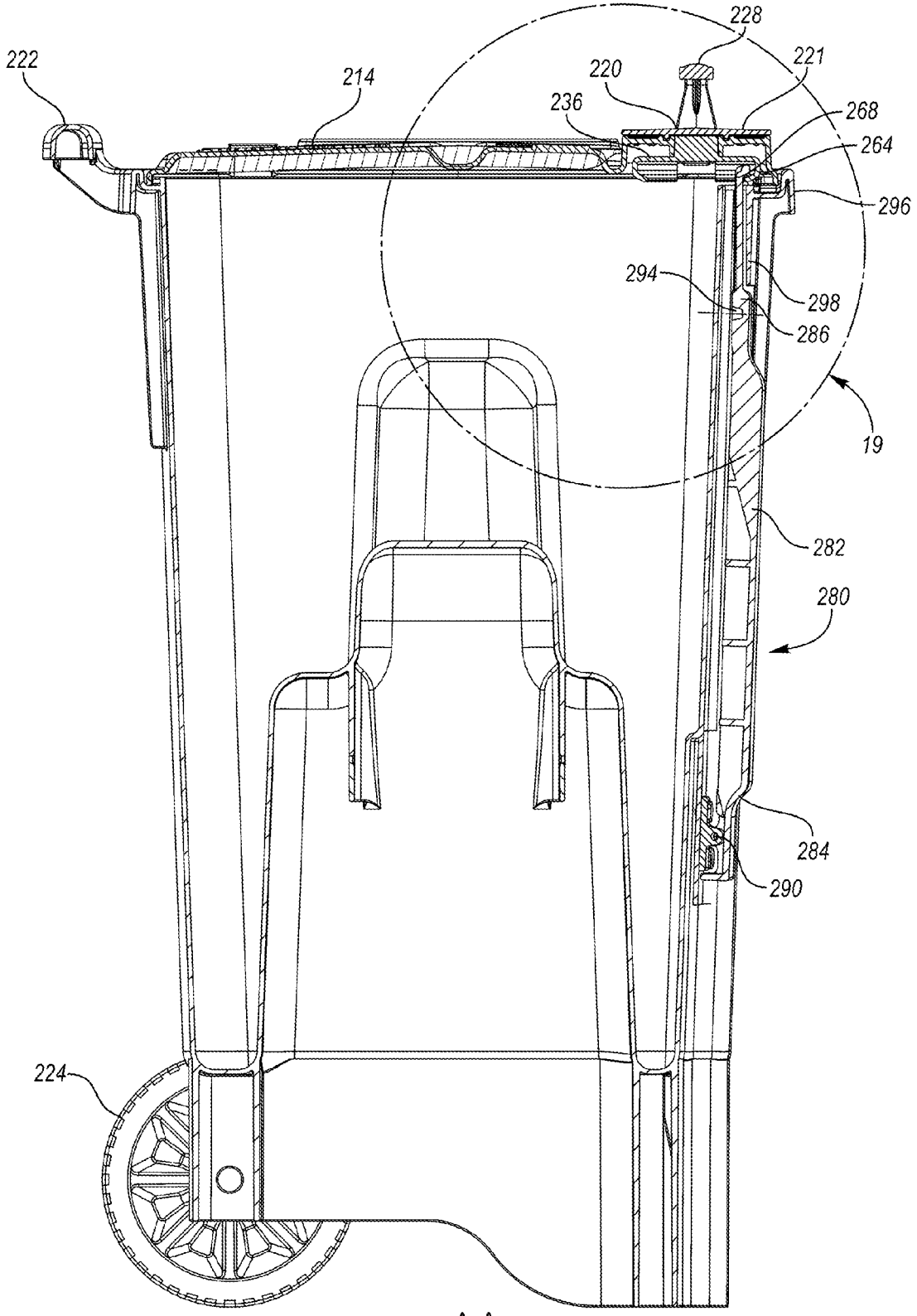
FIG. 18 is a side section view of the container of FIG. 13.

FIG. 18 shows a section view taken along line A-A as shown in FIG. 17. The section is taken through the latch assembly 220 and the release component 280. As shown in FIG. 18, the upper end 286 of the compression bar 282 includes an outwardly facing hook 268. Thus, instead of the hook being formed as part of the cart body itself, the hook is now formed as part of the release component 280. In the example shown, the hook 268 is integrally formed as one-piece with the compression bar 282.

Figure 19:
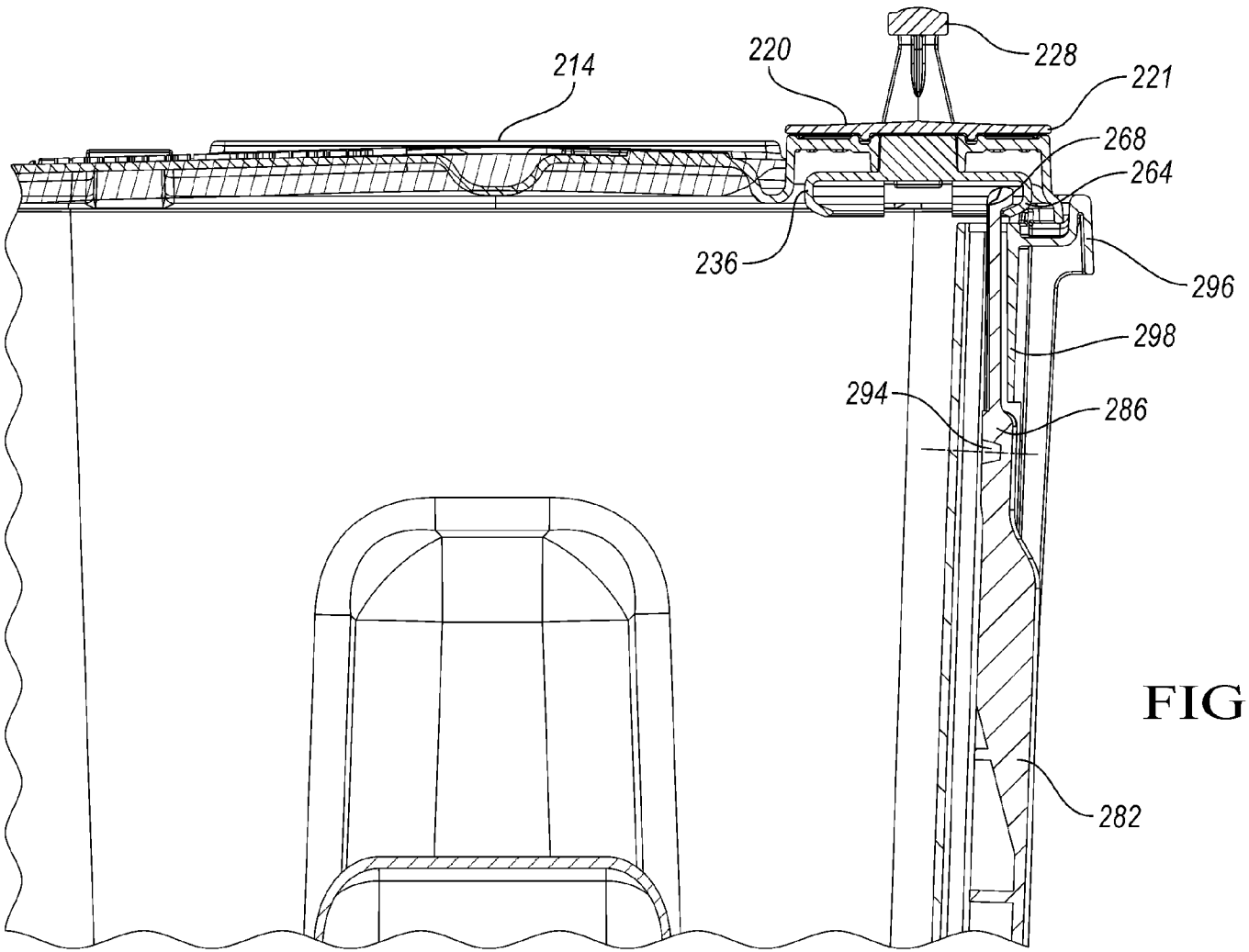
FIG. 19 is a magnified view of the identified section of FIG. 18.

The hook 268 engages the latch member 264 of the latch lower portion 236 thus, latching the lid 214 to the container body 212 as shown in the magnified view of the latch section in FIG. 19. The release component 280 also includes one or more springs 294 positioned between the side wall 216 and an inner facing surface of the compression bar 282. The springs 294 bias the hook 268 into locking engagement with the latch member 264. When the compression bar 282 is compressed toward the side wall 216 by arms of a cart lifter, the spring force is overcome and the hook 268 is released from the latch member 264. The latch assembly 220 includes the upper latch portion 221, lower latch portion 236, and hook 268.

The lid 214 includes a lip 296 that extends outwardly and then downwardly from an upper edge of the container body 212 (FIG. 16). The side wall 216 includes an extension portion 298 that is open at the bottom such that the upper end 286 of the compression bar 282 can extend underneath the lid 214 to interact with the latch 264 (see FIG. 19). The lip 296 is located outwardly of the hook 268 and latch 264.

In use, a user places waste in the container body 212 and rotates the handle 228 of the latch assembly 220 about an axis generally transverse to the lid 214 to the locked position, in which the handle 228 is aligned with the locked indicia 230. This latches the lid 214 to the container body 212.

On waste pick-up day, the user can wheel the roll out cart 210 to the curb and leave the handle 228 of the latch 20 in the locked position such that rodents will be prevented from unlatching the lid while the cart sits at the curb. When the driver of the waste truck arrives, it does not matter whether the lid 214 is locked or unlocked. The driver can use the cart lifter on the truck to grab opposing side wall portions 216*b*, 216*c* of the cart which will cause compression bar 282 to be compressed against the side wall 216. This will move the hook 268 out of engagement with the latch 264 such that the cart lifter can lift the cart 210, the lid 214 will open, and the contents in the container can be dumped into the truck.

Figure 20A:
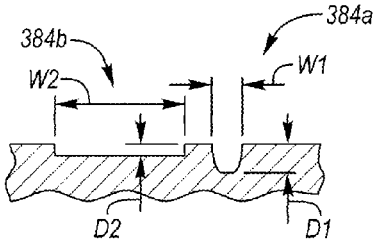
FIG. 20A is a schematic representation comparing first and second sub-sets of channels as shown in FIG. 20.
Figure 20:
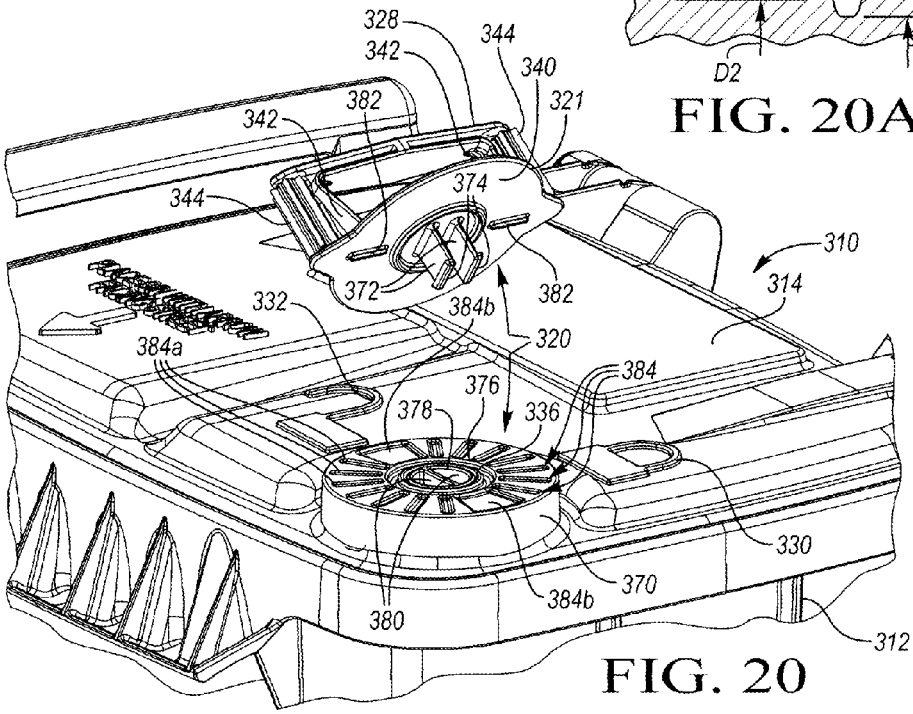
FIG. 20 is a top perspective view of a lid with another embodiment of a latch.
Figure 21:
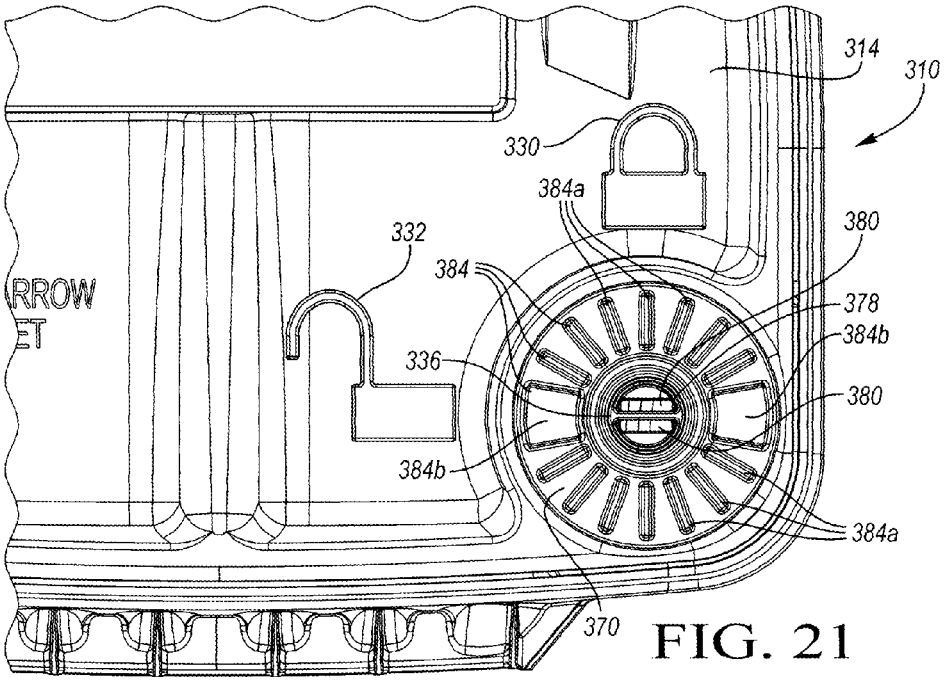
FIG. 21 is a top view of FIG. 20.

FIGS. 20-21 illustrate an alternate cart 310 with an alternate latch configuration. The cart 310 has a lid 314 pivotably connected to a container body 312 for selectively providing access to an interior of the container body 312. A latch 320 selectively prevents the lid 314 from opening. The latch 320 operates in a manner similar to the latch 20 or 220 discussed above. Further, the latch 320 could also be used with the carousel 170 as shown in the embodiment of FIGS. 9-12.

The latch 320 is rotatable relative to the lid 314 and includes a handle 328 that is rotatable in a plane generally parallel to the lid 314. Locked indicia 330 and unlocked indicia 332 may be molded into the upper surface of the lid 314. When the handle 328 of the latch 320 is rotated into alignment with the locked indicia 330, this indicates that the latch 320 is locked and the lid 314 cannot be opened by a user gripping the lid in an attempt to rotate the lid 314 relative to the body 312. When the handle 328 of the latch 320 is rotated into alignment with the unlocked indicia 332, this indicates that the latch 320 is unlatched and the lid 314 can be opened.

As shown in FIG. 20, the latch 320 includes the handle 328 as part of an upper latch portion 321. The latch 320 further includes a generally disc-shaped lower latch portion 336 (similar to lower latch portions 36, 236 described above) below the lid 314 and snap-fit (or otherwise connected) to the upper latch portion 321. The upper latch portion 321 includes a base 340 having supports 342 extending to the handle 328. Paddles or rotatable members 344 extend between the handle 328 and the base 320 outward of the supports 342. The rotatable members 344 operate as described above.

The upper latch portion 321 interfaces with a raised boss 370 that extends outwardly from an upper surface of the lid 314. The base 340 includes a bottom surface with a pair of downwardly extending prongs 372 having hooked ends 374. The boss 370 includes an opening 376 through which the prongs 372 extend.

The lower latch portion 336 includes a protrusion 378 that is received within the opening 376 via a bottom of the lid 314. The protrusion 378 includes a pair of slots or openings 380 that receive the prongs 372 such that the hooked ends 374 of the upper latch portion 321 can be snapped to the lower latch portion 336.

The lower surface of the base 340 also includes one or more raised ribs 382. In one example, the ribs 382 extend in a radial direction and are circumferentially spaced apart from each other relative to the opening 376 in the boss 370.

The lid 314 includes a mount area for the upper latch portion 321. In one example, the mount area comprises an upper surface of the boss 370, which includes a plurality of channels 384 that extend in a radial direction and which are circumferentially spaced apart from each other relative to the opening 376. As shown in FIG. 20A, one sub-set of the channels 384*a* are defined by a first depth D1 and another sub-set of the channels 384*b* are defined by a second depth D2 that is less than the first depth D1. In the example shown, the first sub-set 384*a* has a greater number of channels than the second sub-set 384*b*. Further, the channels in the first sub-set 384*a* are narrower than the channels in the second sub-set 384*b*, i.e. the first sub-set of channels 384*a* has a first width W1 and the second sub-set of channels 384 has a second width W2 that is greater than the first width W1. In the example shown, the channels 384*b* of the second sub-set are generally aligned with the unlocked indicia 332.

The ribs 382 create friction between the boss 370 and upper latch portion 321 such that the handle 328 does not spin freely. The area that allows the latch 320 to become disengaged, i.e. the second sub-set of channels 384*b*, is not as deep as the other sub-set of channels 384*a*. Thus, a slip point is provided such that if a rodent is pulling the handle 328, the handle will slide easily pass the unlocking areas and jump back into one of the locked areas.

Figure 22:
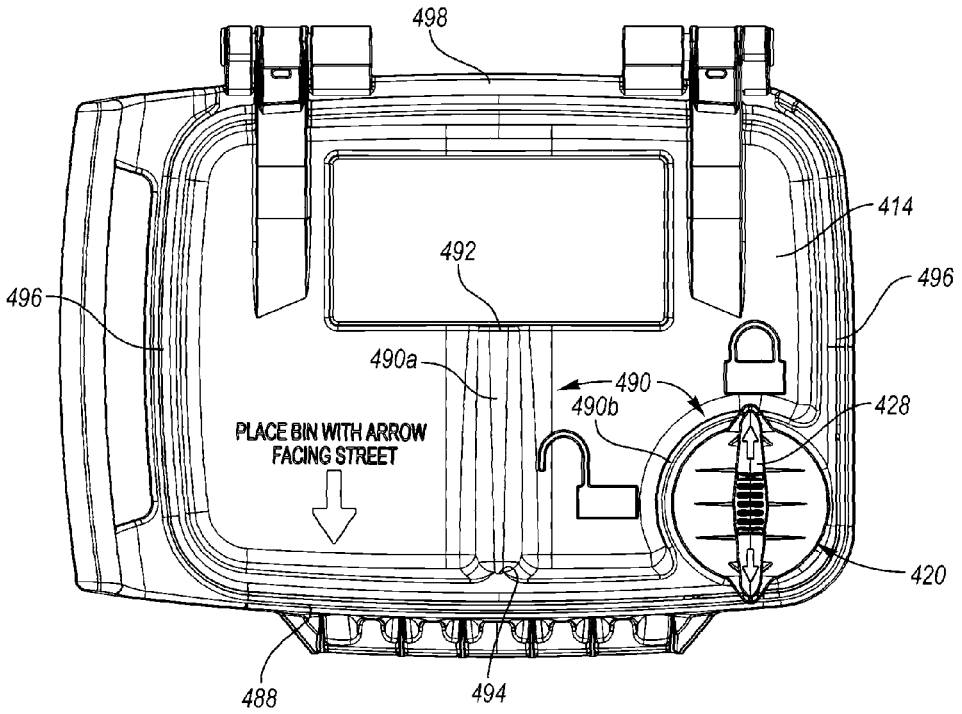
FIG. 22 is a top view of a lid with another embodiment of a latch.
Figure 23:
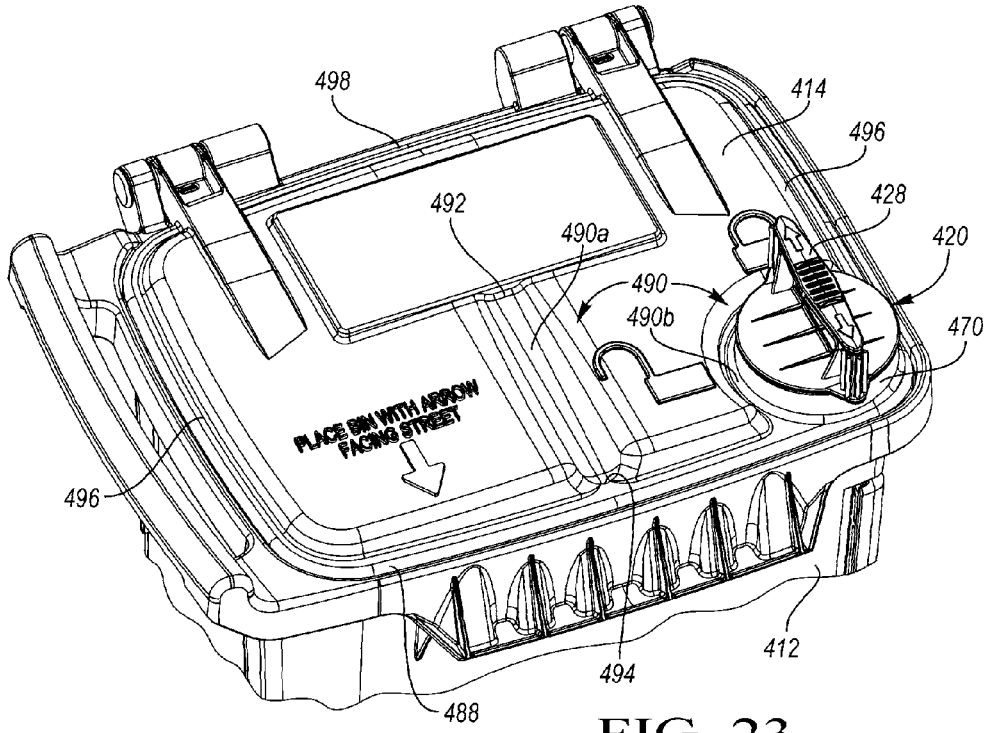
FIG. 23 is a side perspective view of the lid of FIG. 22.
Figure 24:
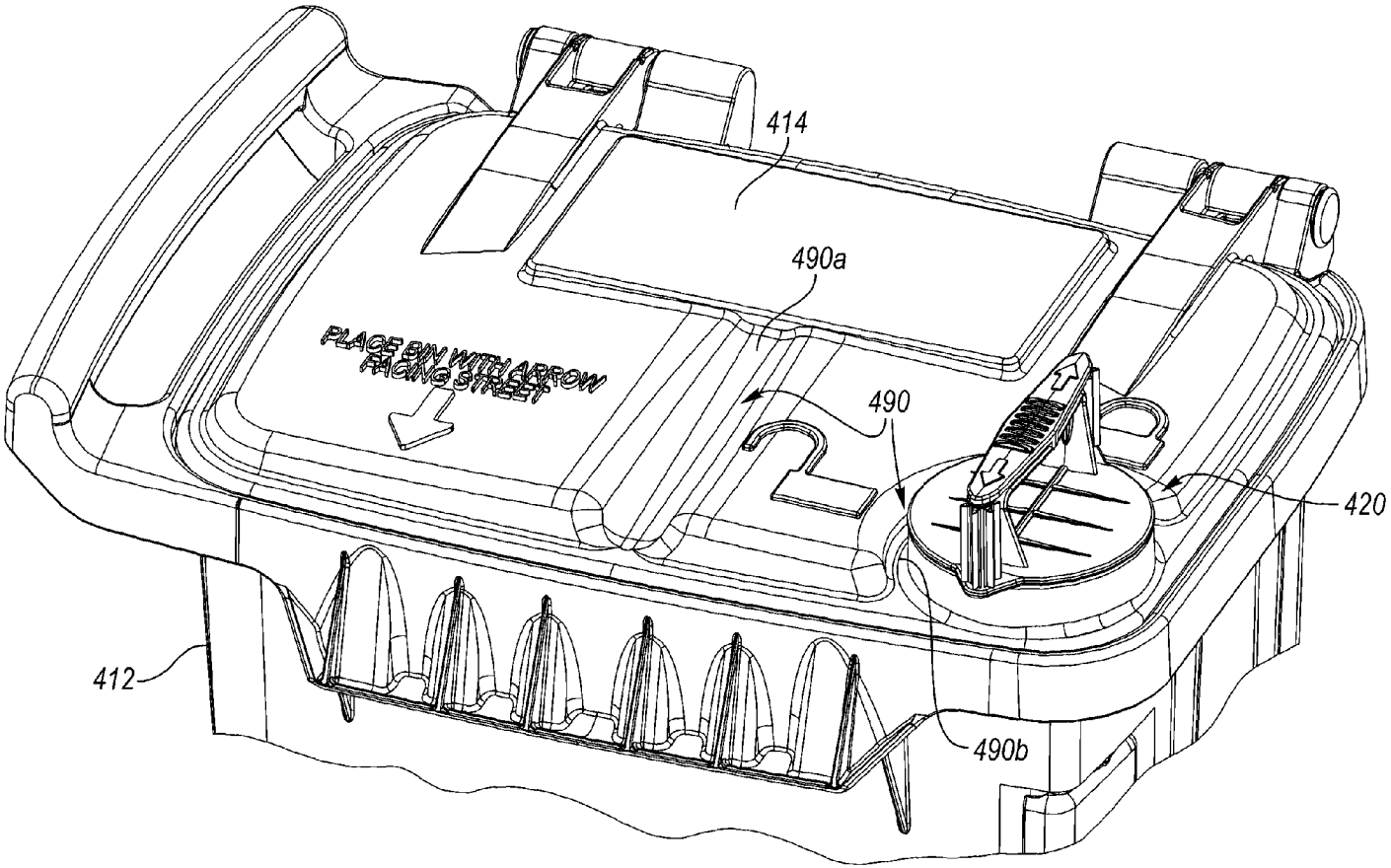
FIG. 24 is a front perspective view of the lid of FIG. 22.

FIGS. 22-24 show another alternate lid configuration. A lid 414 is attached to a cart body 412 as described above. The lid 414 includes a one or more channels 490 that reduce the amount of flex for the lid 414. The channels 490 make it harder for a rodent to pull one side of the lid 414 open. Thus, the channels 490 are formed within the lid at specific locations to control flexing movement of the lid 414 to thwart animal attempts to create enough leveraging force to pry open the lid.

In the example shown in FIGS. 22-24, the lid 414 includes a first channel 490*a* and a second channel 490*b*. The first channel 490*a* is located generally at a center of the lid 414 and extends from a first end 492 to a second end 494. The first end 492 is positioned generally at a center of the lid 414 and the channel extends axially to the second end 494 which is open to an edge of the lid 414. In the example shown, the first channel 490*a* is generally parallel to side edges 496 of the lid 414 and is transverse to front 488 and rear 498 edges of the lid 414.

The second channel 490*b* comprises a flexing channel that is formed to extend at least partially about a boss portion 470 formed within the lid 414 for a latch 420. The latch 420 can comprise any of the latch configurations described above. The flexing channels 490*a*, 490*b* combat the lid from being leveraged open by a handle 428 of the latch 420. The channels keep the corners opposite of the handle 428 from pulling up when the handle 428 is being pulled.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A waste container including:

a body having a base and a side wall extending in a vertical direction upward from the base to define a container interior;

a lid hingeably secured to an upper portion of the side wall;

a latch assembly selectively securing the lid to the side wall, the latch assembly including a handle portion and a rotatable latch portion rotatable about a vertical axis, the rotatable latch portion having a latch member movable about the vertical axis, the latch member selectively interlocking with a hook portion;

at least one additional rotatable member mounted to the latch assembly, the at least one additional rotatable member being independently rotatable relative to the rotatable latch portion; and at least one flexing channel formed within the lid to control flexing movement of the lid.

2. The waste container according to claim 1, wherein the hook portion is formed at an upper edge of the side wall, and wherein the latch member is selectively rotatable about the vertical axis which is generally transverse to the lid, and wherein the latch member engages the hook portion when in a latched position to prevent the lid from opening.

3. The waste container according to claim 2, wherein the hook portion is integrally formed with the side wall as one-piece.

4. The waste container according to claim 1, including a release component associated with the side wall, the release component selectively actuatable to release the latch assembly from a latched position to allow the lid to be opened.

5. The waste container according to claim 1, wherein the at least one flexing channel comprises a first channel extending at least partially about the latch assembly.

6. The waste container according to claim 5, wherein the at least one flexing channel comprises a second channel extending in an axial direction across a central portion of the lid.

7. A waste container including:

a body having a base and a side wall extending in a vertical direction upward from the base to define a container interior;

a lid hingeably secured to an upper portion of the side wall;

a latch assembly selectively securing the lid to the side wall, the latch assembly including a handle portion and a rotatable latch portion rotatable about a vertical axis, the rotatable latch portion having a latch member movable about the vertical axis, the latch member selectively interlocking with a hook portion; and at least one additional rotatable member mounted to the latch assembly, the at least one additional rotatable member being independently rotatable relative to the rotatable latch portion, and wherein the at least one additional rotatable member comprises at least one paddle associated with the handle portion.

8. The waste container according to claim 7, wherein the latch assembly includes an upper latch portion with at least one support to which the handle portion is attached, and wherein the at least one paddle is positioned radially outward of the at least one support.

9. The waste container according to claim 8, wherein the at least one support comprises at least a pair of supports that support the handle, and wherein the at least one paddle comprises at least a pair of paddles with one paddle being located radially outward of one support of the pair of supports and the other paddle being located radially outward of the other support of the pair of supports.

10. A waste container including:

a body having a base and a side wall extending upward from the base to define a container interior;

a lid hingeably secured to an upper portion of the side wall;

a latch assembly selectively securing the lid to the side wall, the latch assembly including a handle portion and a rotatable latch portion rotatable about an axis, the rotatable latch portion having a latch member movable about the axis, the latch member selectively interlocking with a hook portion; and at least one additional rotatable member mounted to the latch assembly, the at least one additional rotatable member being independently rotatable relative to the rotatable latch portion, and wherein the at least one additional member comprises a carrousel that at least partially surrounds the handle portion.

11. The waste container according to claim 10, wherein the carrousel comprises a cylindrical body with a carrousel handle extending across the cylindrical body, and wherein the carrousel handle is rotatable relative to the handle portion between a non-aligned position where the carrousel handle is out of alignment with the handle portion and an aligned position where the carrousel handle is aligned with the handle portions such that a user can grasp the carrousel handle and the handle portion simultaneously.

12. The waste container according to claim 11, wherein the cylindrical body includes a plurality of fins circumferentially spaced apart from each other and wherein each fin is separated from and adjacent fin by at least one opening.

13. A waste container including:

a body having a base and a side wall extending upward from the base to define a container interior;

a lid hingeably secured to an upper portion of the side wall;

a latch assembly selectively securing the lid to the side wall, the latch assembly including a handle portion and a rotatable latch portion rotatable about an axis, the rotatable latch portion having a latch member movable about the axis, the latch member selectively interlocking with a hook portion; and at least one additional rotatable member mounted to the latch assembly, the at least one additional rotatable member being independently rotatable relative to the rotatable latch portion, and wherein the hook portion is formed at an upper edge of the side wall, and wherein the latch member is selectively rotatable about the vertical axis which is generally transverse to the lid, and wherein the latch member engages the hook portion when in a latched position to prevent the lid from opening, and wherein the latch member extends downward and then radially inward below the hook portion when the latch member is in the latched position.

14. A waste container including:

a body having a base and a side wall extending in a vertical direction upward from the base to define a container interior;

a lid hingeably secured to an upper portion of the side wall;

a latch assembly selectively securing the lid to the side wall, the latch assembly including a handle portion and a rotatable latch portion rotatable about a vertical axis, the rotatable latch portion having a latch member movable about the vertical axis, the latch member selectively interlocking with a hook portion;

at least one additional rotatable member mounted to the latch assembly, the at least one additional rotatable member being independently rotatable relative to the rotatable latch portion; and a release component associated with the side wall, the release component selectively actuatable to release the latch assembly from a latched position to allow the lid to be opened, and wherein the release component releases the latch assembly without rotating the latch member.

15. A waste container including:

a body having a base and a side wall extending in a vertical direction upward from the base to define a container interior;

a lid hingeably secured to an upper portion of the side wall;

a latch assembly selectively securing the lid to the side wall, the latch assembly including a handle portion and a rotatable latch portion rotatable about a vertical axis, the rotatable latch portion having a latch member movable about the vertical axis, the latch member selectively interlocking with a hook portion;

at least one additional rotatable member mounted to the latch assembly, the at least one additional rotatable member being independently rotatable relative to the rotatable latch portion; and a release component associated with the side wall, the release component selectively actuatable to release the latch assembly from a latched position to allow the lid to be opened, and wherein the release component comprises a compression bar having a first end pivotally attached to the side wall and a second end selectively engageable with the latch member when in the latched position.

16. The waste container according to claim 15, wherein the hook portion is formed at the second end of the compression bar.

17. The waste container according to claim 15, including at least one resilient member to bias the compression bar to the latched position.

18. A waste container including:

a body having a base and a side wall extending in a vertical direction upward from the base to define a container interior;

a lid hingeably secured to an upper portion of the side wall;

a latch assembly selectively securing the lid to the side wall, the latch assembly including a handle portion and a rotatable latch portion rotatable about a vertical axis, the rotatable latch portion having a latch member movable about the vertical axis, the latch member selectively interlocking with a hook portion;

at least one additional rotatable member mounted to the latch assembly, the at least one additional rotatable member being independently rotatable relative to the rotatable latch portion; and a release component associated with the side wall, the release component selectively actuatable to release the latch assembly from a latched position to allow the lid to be opened, and wherein the release component and latch assembly are independently operable of each other to move out of the latched position.

19. A waste container including:

a body having a base and a side wall extending upward from the base to define a container interior;

a lid hingeably secured to an upper portion of the side wall;

a latch assembly selectively securing the lid to the side wall, the latch assembly including a handle portion and a rotatable latch portion rotatable about an axis, the rotatable latch portion having a latch member movable about the axis, the latch member selectively interlocking with a hook portion;

at least one additional rotatable member mounted to the latch assembly, the at least one additional rotatable member being independently rotatable relative to the rotatable latch portion, wherein the handle portion comprises an upper latch portion mounted on an external side of the lid and wherein the rotatable latch portion with the latch member comprises a lower latch portion and is mounted an internal side of the lid, wherein the upper latch portion and lower latch portion are secured to rotate together; and wherein the upper latch member comprises a base having an upper side supporting the handle portion and a lower side that includes one of a plurality of ribs or channels, and wherein the external side of the lid includes a mount area for the upper latch portion, the mount area includes the other of the plurality of ribs or channels, the ribs and channels cooperating with each other to create friction between the lid and upper latch portion during rotation between latched and unlatched positions.

20. The waste container according to claim 19, wherein the plurality of channels comprises a first sub-set of channels having a first depth and a second sub-set of channels being defined by a second depth that is less than the first depth, and wherein the second sub-set of channels are aligned with the unlatched position.

21. The waste container according to claim 20, wherein the first sub-set of channels has a first width and the second sub-set of channels has a second width that is greater than the first width.

22. The waste container according to claim 20, wherein the first sub-set of channels has a greater number of channels than the second sub-set of channels.

23. The waste container according to claim 20, wherein the mount area includes the plurality of channels and the lower side of the base includes the plurality of ribs.

24. A waste container including:

a body having a base and a side wall extending upward from the base to define a container interior, wherein the side wall defines at least a rear wall associated with a container handle, a front wall opposite the rear wall, and side walls extending between the front and rear walls;

a lid hingeably secured to an upper portion of the side wall;

at least one flexing channel formed within the lid to control flexing movement of the lid, wherein the at least one flexing channel comprises a first channel located generally near a center of the lid, the first channel extending in an axial direction that is defined as extending from the rear wall to the front wall;

a latch assembly selectively securing the lid to the side wall, the latch assembly including a handle portion and a rotatable latch portion rotatable about an axis, the rotatable latch portion having a latch member movable about the axis, the latch member selectively interlocking with a hook portion; and at least one additional rotatable member mounted to the latch assembly, the at least one additional rotatable member being independently rotatable relative to the rotatable latch portion.

25. The waste container according to claim 24, wherein the first channel has a first end located generally at a center of the lid and a second end that extends to the front wall.

26. The waste container according to claim 24, wherein the at least one flexing channel further comprises a second channel extending at least partially around the latch assembly.

27. A waste container including:

a body having a base and a side wall extending upward from the base to define a container interior;

a lid hingeably secured to an upper portion of the side wall;

a latch assembly selectively securing the lid to the side wall, the latch assembly including a handle portion and a rotatable latch portion rotatable about an axis, the rotatable latch portion having a latch member movable about the axis, the latch member selectively interlocking with a hook portion; and a release component associated with the side wall, the release component selectively actuatable to release the latch assembly from a latched position to allow the lid to be opened, wherein the release component and latch assembly are independently operable of each other to move out of the latched position, and wherein the release component comprises a compression bar having a first end pivotally attached to the side wall and a second end selectively engageable with the latch member when in the latched position.

28. The waste container according to claim 27, wherein the release component releases the latch assembly without rotating the latch member.

29. The waste container according to claim 27, wherein the hook portion is formed at the second end of the compression bar.

30. The waste container according to claim 27, including at least one resilient member to bias the compression bar to the latched position.

31. The waste container according to claim 27, including at least one additional rotatable member mounted to the latch assembly, the at least one additional rotatable member being independently rotatable relative to the rotatable latch portion.

32. The waste container according to claim 27, including at least one flexing channel formed within the lid to control flexing movement of the lid.

33. A waste container including:

a body having a base and a side wall extending upward from the base to define a container interior;

a lid hingeably secured to an upper portion of the side wall;

a latch assembly selectively securing the lid to the side wall, the latch assembly including a handle portion and a rotatable latch portion rotatable about an axis, the rotatable latch portion having a latch member movable about the axis, the latch member selectively interlocking with a hook portion;

a release component associated with the side wall, the release component selectively actuatable to release the latch assembly from a latched position to allow the lid to be opened, wherein the release component and latch assembly are independently operable of each other to move out of the latched position; and wherein the handle portion comprises an upper latch portion mounted on an external side of the lid and the rotatable latch portion with the latch member comprises a lower latch portion and is mounted an internal side of the lid, wherein the upper latch portion and lower latch portion are secured to rotate together, and wherein the upper latch member comprises a base having an upper side supporting the handle portion and a lower side that includes one of a plurality of ribs or channels, and wherein the external side of the lid includes a mount area for the upper latch portion, the mount area includes the other of the plurality of ribs or channels, the ribs and channels cooperating with each other to create friction between the lid and upper latch portion during rotation between latched and unlatched positions.

34. A waste container including:

a body having a base and a side wall extending in a vertical direction upward from the base to define a container interior;

a lid hingeably secured to an upper portion of the side wall;

a latch assembly selectively securing the lid to the side wall, the latch assembly including an upper latch portion with a handle portion and a lower latch portion rotatable about a vertical axis, the lower latch portion having a latch member movable about the axis, the latch member selectively interlocking with a hook portion, and wherein the upper latch portion comprises a base having an upper side supporting the handle portion and a lower side that includes one of a plurality of ribs or channels; and wherein the external side of the lid includes a mount area for the upper latch portion, the mount area including the other of the plurality of ribs or channels, and wherein the ribs and channels cooperate with each other to create friction between the lid and upper latch portion during rotation between latched and unlatched positions.

35. A waste container including:

a body having a base and a side wall extending upward from the base to define a container interior;

a lid hingeably secured to an upper portion of the side wall, wherein the lid includes at least one flexing channel to control flexing movement of the lid;

a latch assembly selectively securing the lid to the side wall, the latch assembly including a handle portion and a rotatable latch portion rotatable about an axis, the rotatable latch portion having a latch member movable about the axis, the latch member selectively interlocking with a hook portion, and wherein the at least one flexing channel comprises at least one of a first channel extending in an axial direction across a central portion of the lid and a second channel that extends at least partially around the latch assembly.

* * * * *